US012735226B2

(12) United States Patent
Dolcini

(10) Patent No.: US 12,735,226 B2
(45) Date of Patent: Sep. 15, 2026

(54) UNIVERSAL HOLDER FOR BOTTLES OF PRODUCTS IN FLUID STATE

(71) Applicant: MATRIX STAMPI S.R.L., Osimo (IT)

(72) Inventor: Pierluigi Dolcini, Porto Recanati (IT)

( * ) Notice: Subject to any disclaimer, the term of this patent is extended or adjusted under 35 U.S.C. 154(b) by 0 days.

(21) Appl. No.: 19/121,356

(22) PCT Filed: Oct. 10, 2023

(86) PCT No.: PCT/IB2023/060149

§ 371 (c)(1),
(2) Date: Apr. 15, 2025

(87) PCT Pub. No.: WO2024/089508

PCT Pub. Date: May 2, 2024

(65) Prior Publication Data

US 2026/0138785 A1 May 21, 2026

(30) Foreign Application Priority Data

Oct. 26, 2022 (IT) ..... 102022000022089

(51) Int. Cl.
*B65D 23/00* (2006.01)

(52) U.S. Cl.
CPC ..... *B65D 23/003* (2013.01)

(58) Field of Classification Search
CPC .... B65D 23/003; B65D 5/4208; B65D 25/22; B65D 33/14; B65D 35/245; B65D 35/56; B65D 35/565; B65D 63/109
See application file for complete search history.

(56) References Cited

U.S. PATENT DOCUMENTS

| | | | | |
|---|---|---|---|---|
| 2,289,701 | A * | 7/1942 | Engel | B60N 3/103 248/311.2 |
| 2,760,262 | A * | 8/1956 | Homan | B65D 25/32 215/397 |
| 3,259,262 | A * | 7/1966 | Grossman | A61M 5/1417 215/397 |
| 4,747,519 | A * | 5/1988 | Green | B65D 23/003 248/339 |
| 4,969,580 | A | 11/1990 | Ezzat | |
| 5,435,513 | A * | 7/1995 | Davis | B65D 23/003 248/340 |
| 7,775,458 | B2 | 8/2010 | Linstedt et al. | |
| 2006/0255007 | A1 | 11/2006 | Velardi | |

OTHER PUBLICATIONS

International Search Report for corresponding PCT/IB2023/060149 dated Jan. 8, 2024.
Written Opinion of the International Searching Authority for corresponding PCT/IB2023/060149 dated Jan. 8, 2024.

* cited by examiner

*Primary Examiner* — Kareen K Thomas
(74) *Attorney, Agent, or Firm* — Egbert, McDaniel & Swartz, PLLC

(57) ABSTRACT

Holder for bottles of products in fluid state, preferably for hygienic and cosmetic use, including a central portion provided with a flexible strap, so that the bottle of the product to be dispensed is disposed in upside-down position against the central portion and held in such a position by the strap that is effectively capable of embracing and holding the bottle tightly against the central portion.

12 Claims, 5 Drawing Sheets

UNIVERSAL HOLDER FOR BOTTLES OF PRODUCTS IN FLUID STATE

The present patent application for industrial invention relates to a universal holder for bottles of products in fluid state, preferably shampoo or shower gel.

The peculiarities and advantages of the present invention will become more apparent following a brief description of the prior art and its drawbacks.

Currently, personal hygiene products—such as shower gels and shampoos—are packaged in two main ways.

In a first case, they are packaged inside bottles-dispensers provided at the top with a plunger cap, as well as suitable for being placed on a sink or on the edge of a bathtub, that is, in a useful position to allow the user to press said plunger cap to dispense the product.

In a second case- and with specific reference to the present invention—said products are packaged inside bottles made of an elastically compressible plastic material; each one of said bottles is provided at the top with a small dispensing hole accompanied by a cap equipped with a pin capable of being exactly engaged in said dispensing hole to prevent the product from spilling, and also capable of being easily removed from said hole to enable the dispensing of small quantities of said product.

For greater convenience of use, said cap is attached to the bottle near the dispensing hole, mainly by means of a flexible tab.

Evidently, in such a case, the mere removal of the cap is not sufficient to dispense the product and the bottle needs to be turned upside down to facilitate the dispensing of the product by simple gravity or perhaps-especially when the bottle is almost empty—by means of a compression exerted by the user's hand on the walls of the bottle.

In view of the above, it can be understood how a user who intends to dispense the product contained in the second type of bottles is normally forced to use both hands, one to hold the bottle, the other to remove and replace the cap.

Anyone who has had such an experience knows how one can sometimes feel a certain discomfort, especially in the cramped space of a shower cubicle and in a precarious balance for the user's feet due to the slippery surface of the wet shower tray.

Not to mention that, once the desired amount of shampoo or shower gel is dispensed from the bottle, the user always has the problem of where to place the bottle to prevent it from occupying an unwanted volume inside the shower cubicle.

Currently, trays equipped with one or two hooks are adopted to provide a solution to this problem, said hooks being used to hang the tray on the upper edge of the shower cubicle.

The function of such trays is to hold one or more bottles in upright position in the shower cubicle, so that each user can take such bottles from the "hanging" tray to dispense the desired dose of product and then store them back into the tray.

While it is true that the use of such hanging trays solves the problem of rationally containing the aforementioned bottles in the cramped space of a shower cubicle, it is equally clear that it does not solve the other drawback.

Evidently, reference is made to the need to use both hands to remove the cap from each one of said bottles in order to dispense the product.

Moreover, the presence of one of said hanging trays in the limited space of a shower cubicle generates an encumbrance that limits the freedom of movement of the user, especially if he or she is of sturdy build.

U.S. Pat. No. 4,969,580A describes a hanger support apparatus for bottles of products in fluid state having a body with an L-shaped cross-section comprising a vertical plate and a shelf that protrudes horizontally from the vertical plate. The shelf has a hole into which the mouth of the bottle is inserted so that the bottle is arranged upside down. Such a hanger support apparatus comprises a C-shaped hook suitable for being attached to attachment points of a shower cubicle and a flexible strap that is separate from the body and is suitable for being closed in a loop around the bottle and around the vertical plate of the body to prevent the bottle from tipping over. So, the strap described in U.S. Pat. No. 4,969,580A does not have the function of holding and supporting the bottle in suspended position, but rather has the sole function of preventing the bottle from tipping over as the bottle is supported by the shelf.

It is the purpose of the invention to provide a holder capable of effectively supporting a bottle of shampoo or shower gel in an upside-down position, allowing the user to dispense the product using only one hand, which in itself is sufficient to remove the cap and compress the walls of the bottle to dispense the product.

Another purpose of the invention is to provide a holder capable of supporting bottles of different sections and shapes, thus manifesting a versatility that makes it suitable for being used by the user to store bottles of different shapes and sizes.

Another purpose of the invention is to devise a holder that is not cumbersome and is not provided with shelves protruding from a vertical plate.

Another purpose of the invention is to provide a holder having the dual capability of hanging from the top edge of a shower cubicle or in any other useful horizontal projection, or of being frontally attached to a wall of the shower cubicle or even to a tiled wall of the bathroom.

The purposes of the present invention have been achieved in accordance with the invention with the features listed in the attached independent claim 1.

Advantageous achievements of the holder in question appear from the dependent claims.

In particular, the holder according to the invention is provided with a strap of adjustable length that acts as a holding means for the bottle and is suitable for holding any model of the most common bottles of personal hygiene products in an upside-down position. The strap is elastic and soft in such a way to be compressed and adhere tightly and firmly to the bottle, so that the bottle is held only by the strap The holder according to the invention has a hook, which is similar to that of an ordinary clothes hanger, and may comprise one or more suction cups suitable for adhering to a vertical surface.

For the sake of explanatory clarity, the description of the invention continues with reference to the attached drawings, which are for illustrative and non-limiting purposes only, wherein.

Figure 1:
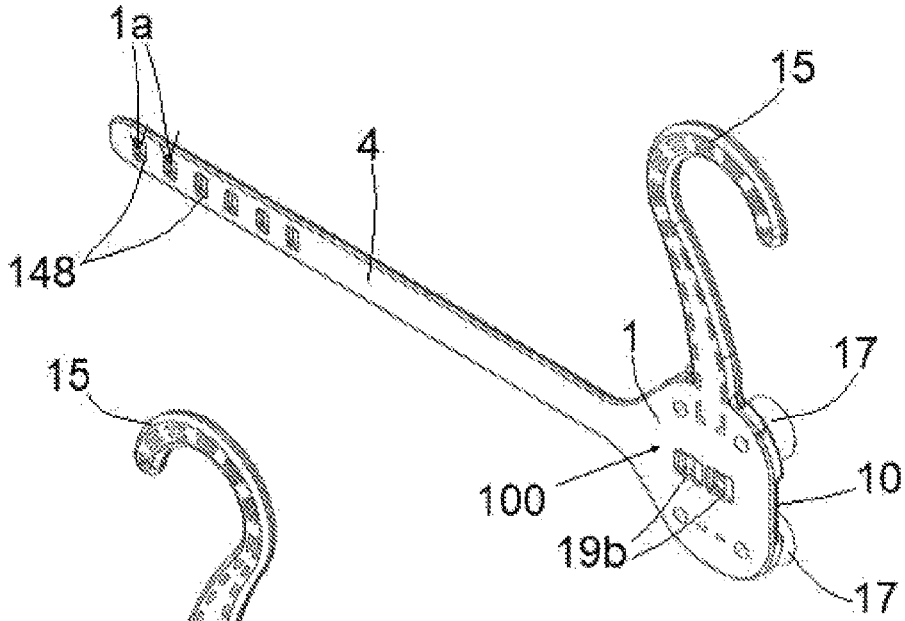
FIG. 1 is an axonometric view of the holder in question seen from its inner surface and still in non-operating position.
Figure 2:
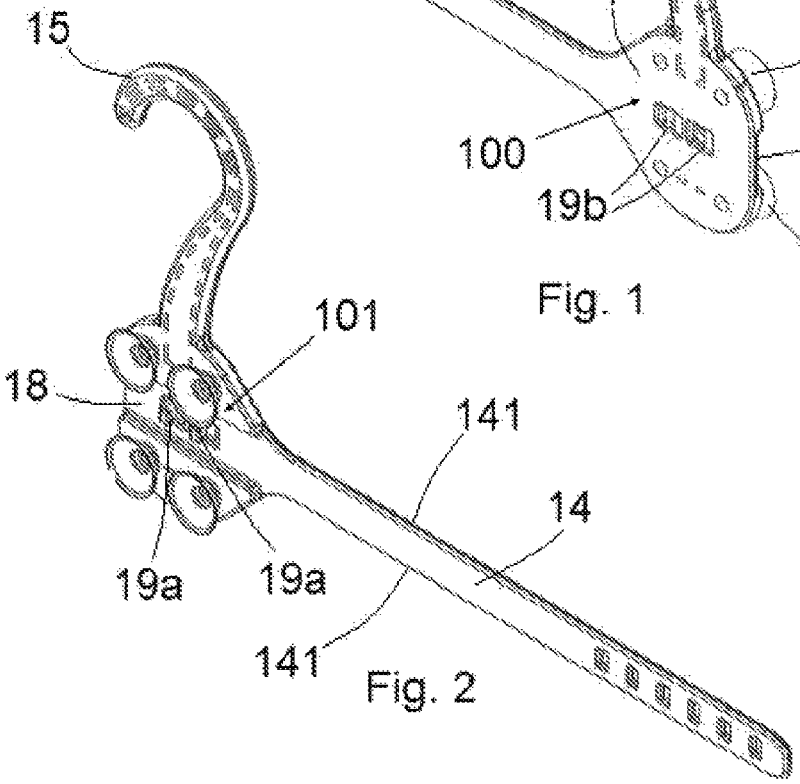
FIG. 2 is an axonometric view of the holder in question seen from its outer surface and still in non-operating position.
Figure 1A:
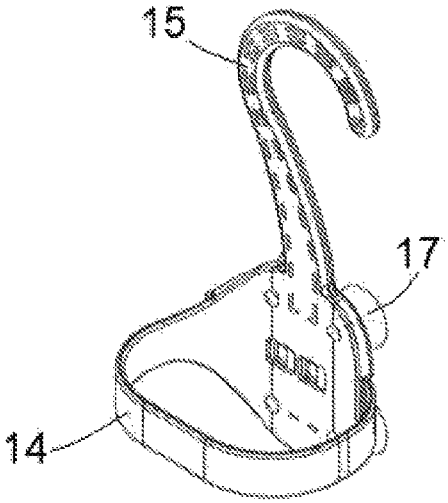
FIG. 1A is similar to the previous one, except for it shows the holder in question in operating position.
Figure 2A:
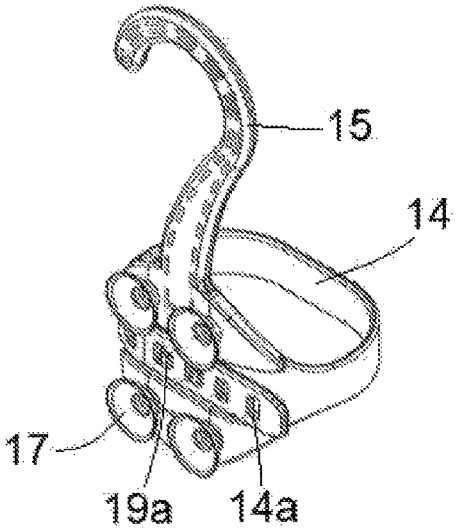
FIG. 2A is similar to the previous one, except for it shows the holder in question in operating position.
Figure 3B:
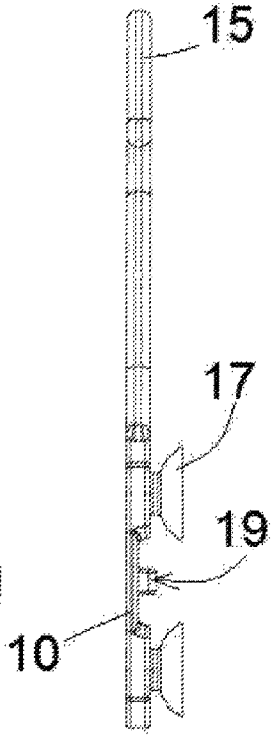
FIGS. 3A and 3B are a top view and a rear view of the device of FIG. 3, respectively.
Figure 3:
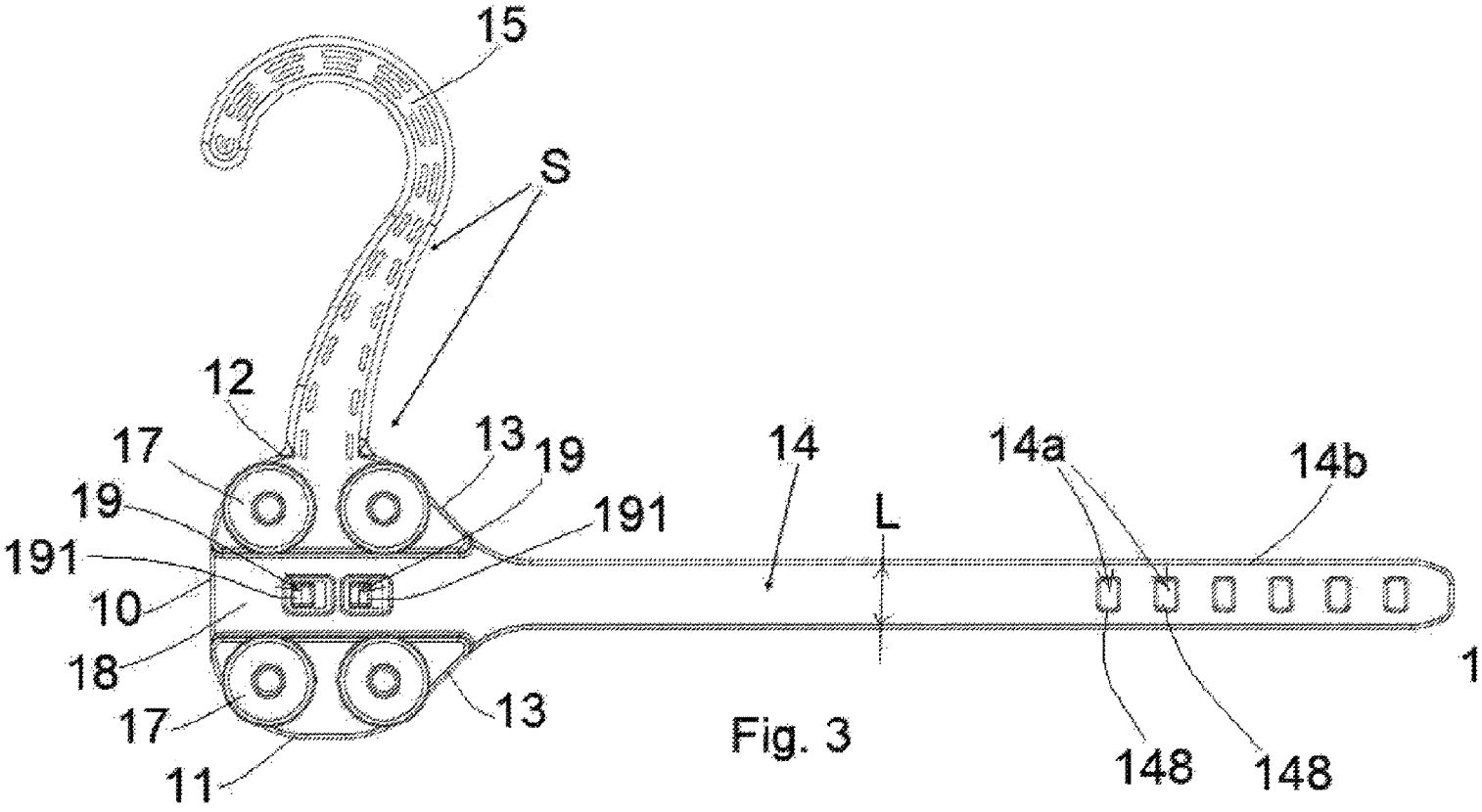
FIG. 3 is a plan view of FIG. 2.
Figure 3A:
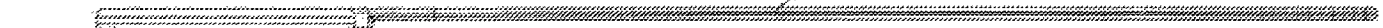

With reference to the appended figures, the holder according to invention(S) comprises a central portion (1) with plate-like configuration suitable for being arranged along a vertical plane and having a substantially square profile.

Said central portion (1) comprises a rear edge (10), a rounded lower edge (11) and a rounded upper edge (12), as well as a front end (13) with a substantially V-shape joined with a flexible strap (14) that protrudes from said central portion (1) in orthogonal position with respect to said rear edge (10).

The flexible strap (14) is provided at its free end (14*b*) with a set of fastening means (14*a*). Said fastening means (14*a*) comprise openings (148), namely regularly spaced vertical slots.

Moreover, the central portion (1) comprises an inner surface (100) and an outer surface (101).

A hook (15) protrudes from said upper edge (12) of said central portion (1), said a hook (15) lying in the same vertical plane that contains the central portion (1).

With particular reference to FIG. 1, suction cups (17) are provided at the four corners of the central portion (1), protruding from said outer surface (101) of the central portion (1).

Locking means (19) are provided on the outer surface (101) of the central portion (1), which are suitable for cooperating with said fastening means (14*a*) of the strap (14) to lock the free end (14*b*) of said strap (14) against the outer surface (101).

Said locking means (19) comprise protruding elements (191) that protrude from the outer surface (101) of the central portion (1) and are suitable for being engaged into the openings (148) of the fastening means (14*a*) for locking the strap (14).

With reference to the attached figures, the protruding elements (191) consist of hooks whose prehensile ends (19*a*) face the direction in which said strap (14) develops.

The outer surface (101) of the central portion (1) is cut by a horizontal central groove (18) that is perfectly aligned with the strap (14) and is provided with a height (L) such to exactly accommodate said free end (14*b*) of said strap (14).

Said locking means (19) are arranged along said groove (18).

In particular, the center distance between the two hooks of the locking means (19) is equal to the center distance between each consecutive pair of the slots of the locking means (14*a*) of the strap (14), and the prehensile ends (19*a*) of said hooks (19) are capable of exactly penetrating into two consecutive slots, firmly engaging them as illustrated below.

The flexible strap (14) is made of an elastic, soft and anti-slip material. Specifically, the strap (14) is made of a plastic material that can be stretched up to eight times its standard length without breaking or tearing. The strap (14) is also capable of compressing elastically in order to hold the bottle (F) tightly.

The flexible strap (14) has two longitudinal edges (141) that extend for the entire length of the flexible strap (14).

Figure 5:
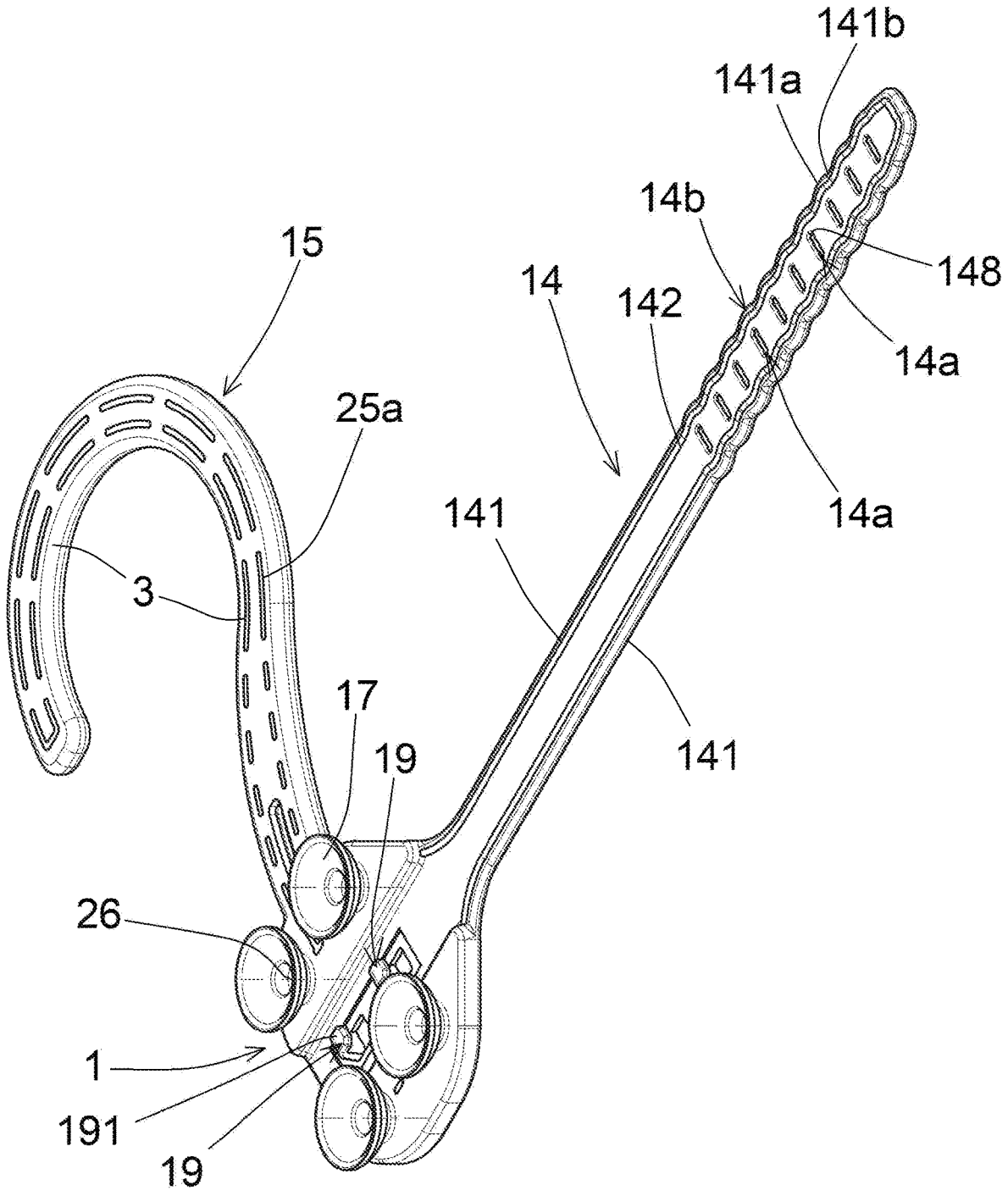
FIG. 5 is an axonometric view of a preferred embodiment of the holder according to the invention.

Referring to FIG. 5, preferably, at the free end (14*b*) of the flexible strap (14), said longitudinal edges (141) have a wavy profile comprising ridges (141*a*) and loops (141*b*).

The ridges (141*a*) are disposed in correspondence with said openings (148), which consist of the vertical slots.

Such a wavy profile provided with the ridges (141*a*) in correspondence with said openings (148) increases the tear strength in the areas where the openings (148) are disposed in order to ensure a greater elasticity and elongation.

In addition, the strap (14) has a peripheral rib (142) that extends all around the flexible strap (14*a*). The peripheral rib (142) further improves the tear strength so that the strap (14) has a greater elasticity and elongation.

Figure 6:
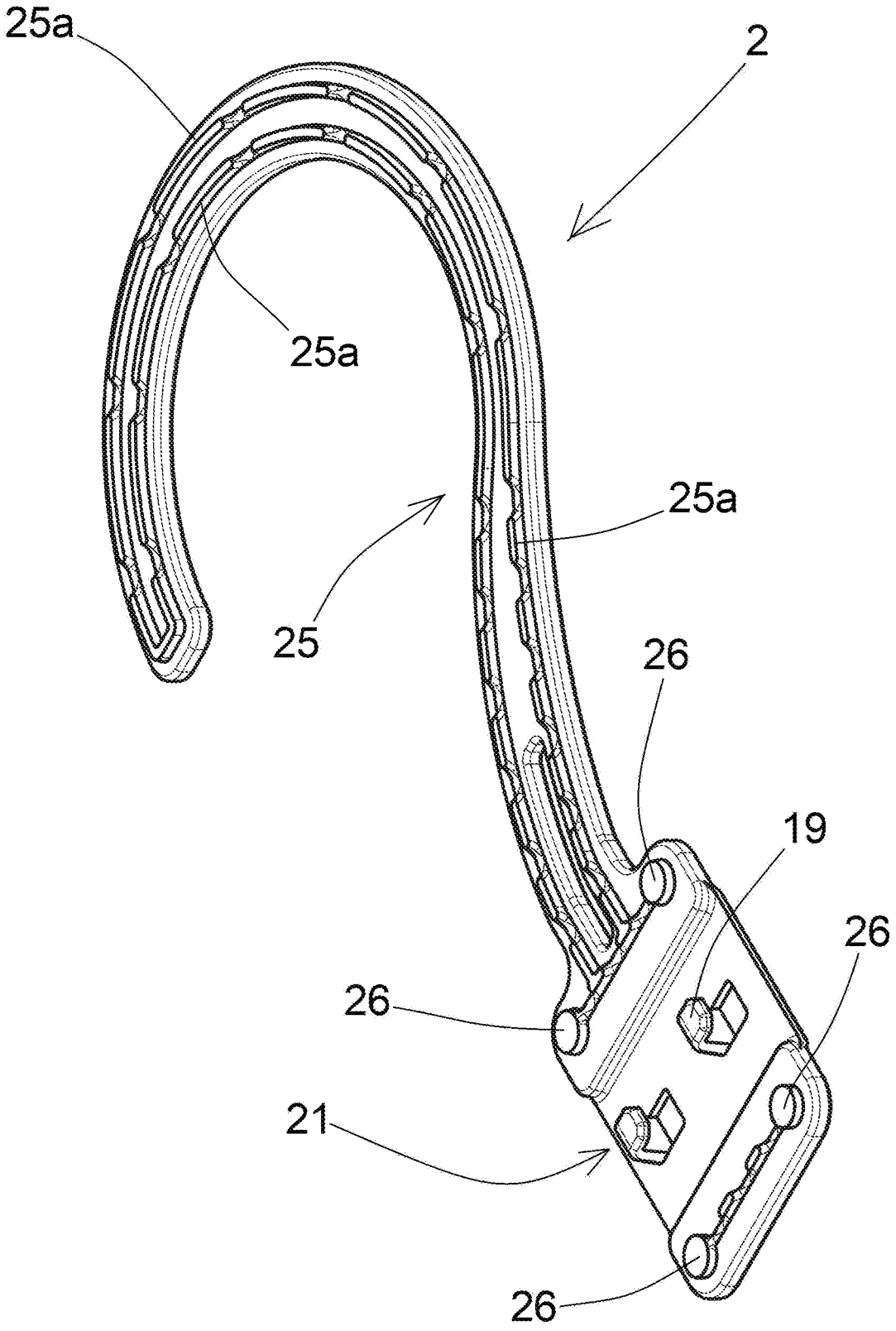
FIG. 6 is an axonometric view of a load-bearing inner core of the holder according to the invention.

Referring to FIGS. 5 and 6, the holder(S) is made of a co-molded material and comprises:

- a load-bearing inner core (2), preferably made of a plastic material, which has a hooked portion (25) having the same profile as the hook (15) and a plate (21) having a profile similar to that of the central portion (1);
- an elastic and soft outer covering (3) that covers the load-bearing inner core (2) and defines said flexible strap (14) and said suction cups (17).

So, the flexible strap (14) and the suction cups (17) are of the same material as the outer covering (3).

The outer covering (3) is made of a softer and more elastic material than the load-bearing inner core (2).

Said locking means (19), which consist of the hooks, are made in one piece with the inner core (2) and project from a respective window (19*b*) that cuts the groove (18) and is made on the elastic outer covering (3).

Partitions (25*a*) are provided along the hooked portion (25) to favor the coupling of the outer covering (3) with the load-bearing inner core (2).

In addition, four pegs (26), each of them supporting a respective suction cup (17), are provided on the plate (21) of the load-bearing inner core (2).

In order to realize the holder(S) according to the invention, the load-bearing inner core (2) is inserted into a special mold and then the plastic material is injected into the mold so that said plastic material covers the load-bearing inner core (2) and generates the flexible strap (14) and the suction cups (17).

Figure 4B:
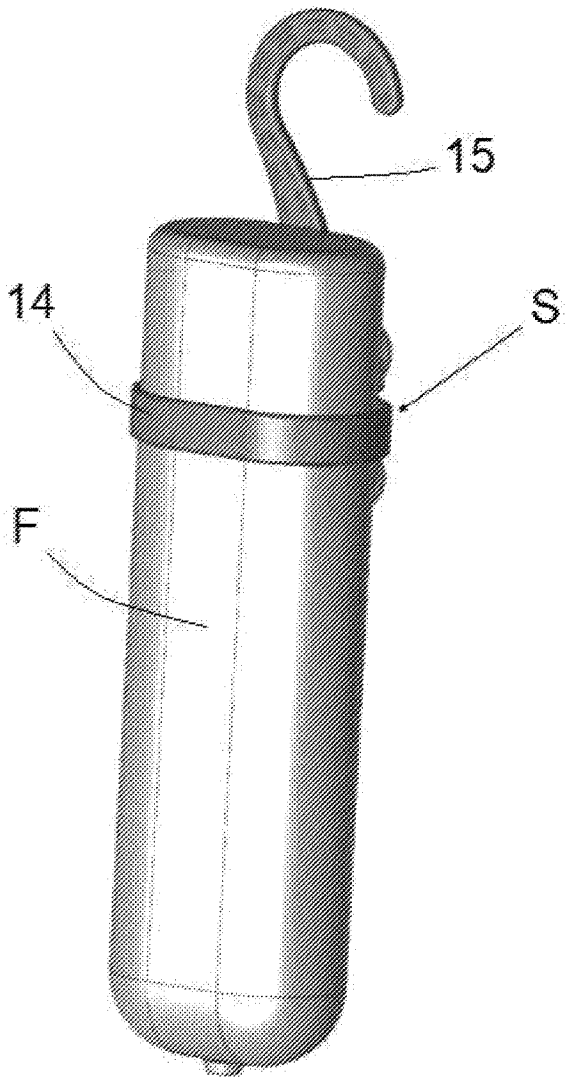
FIGS. 4A and 4B are similar to FIGS. 1A and 2A, except for they show the holder in question when supporting a bottle.
Figure 4A:
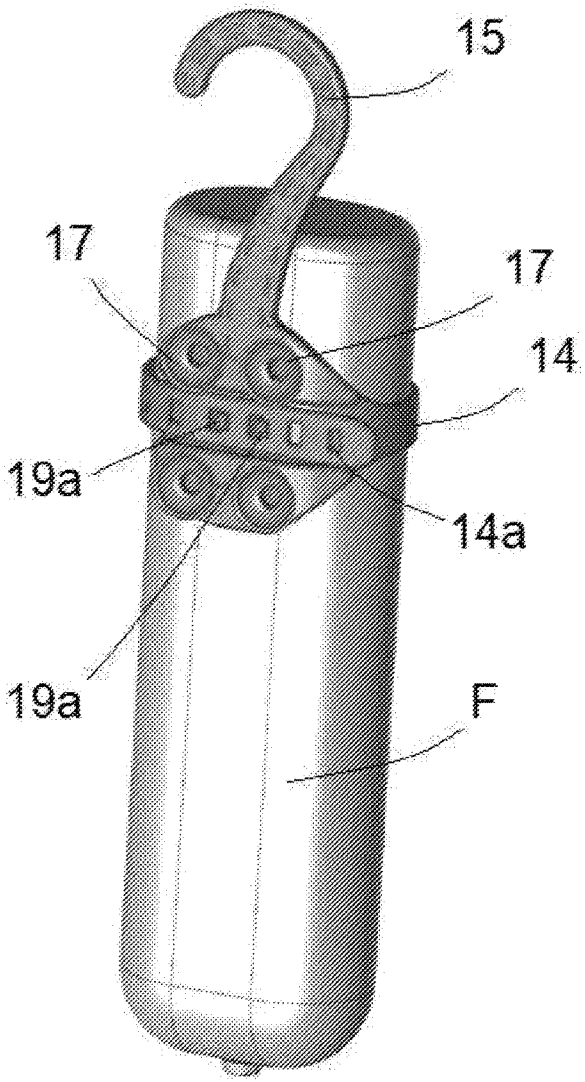

After describing the structure of the holder in question(S), the present description continues by illustrating the ways in which the holder in question(S) is used in association with a bottle (F) of fluid product, in upside down position; in this regard, reference is made to FIGS. 4A and 4B.

Firstly, it is necessary to bring said bottle (F) against the inner surface (100) of the central portion (1) and then embrace it tightly with said flexible strap (14), which, upon completion of such an operation, is disposed in an annular position with its free end (14*b*) overlapping the outer surface (101) of the central portion (1). Moreover, during such a step, the flexible strap (14) is pulled so that it is stretched and firmly tightened to hold the bottle (F).

After properly adjusting the tension of the strap (14) around the bottle (F), it is necessary to lock the strap (14) in annular position, taking advantage of the cooperation of said locking means (19) provided on the outer surface (101) of the central portion (1) with the fastening means (14*a*) of the strap (14), as expressly shown in FIG. 4A.

Particularly, in the embodiment shown in the Figures, wherein the locking means (19) consist of hooks and the fastening means (14*a*) consist of a number of slots obtained on the free end (14*b*) of the strap (14), it is possible to impose an adequate tightening force on the strap (14)—in its cooperation with the hooks—regardless of the larger or smaller section of the bottle (F) that is from time to time mounted on the holder according to the invention(S).

Furthermore, as shown in FIG. 4A, when the strap (14) is in said operating position, said strap (14) is exactly engaged in said groove (18) provided on the outer surface (101) of the central portion (1), in a useful condition to prevent it from undesirably sliding upward or downward with the risk of reducing the effectiveness of its tightening around the bottle (F).

Once such a stable mounting of the bottle (F) inside the holder(S) according to the invention has been completed, the final operation is to place the holder(S) in a position that is easily accessible for the user, either by hanging it by means of the hook (15) or by adhering it to a suitable vertical surface by means of the suction cups (17).

In order to ensure a more effective use of the holder in question(S), preferably, the central portion (1) is made of a rigid material, whereas the strap (14) is made of a soft material in order to ensure its flexibility all around the bottle.

While still falling within the scope of the present inventive idea, the holder according to the invention(S) can adopt different constructive solutions that, however, do not alter its basic functional characteristics or purposes.

In such a view, first of all, it could be envisaged that rather than being obtained in a monolithic version together with the central portion (1), the hook (15) is mounted at the upper edge (12) of the central portion (1) with the interposition of a revolving connection means that allows the user to vary the orientation of said hook (15) according to the point where it is to be hung from time to time.

Similarly, it is possible to provide different locking means (19) on the central portion (1) and different fastening means (14*a*) on the strap (14). By way of example, the protruding elements of the locking means (19) may consist of pins with an enlarged head that project (as an alternative to the aforementioned hooks) from the outer surface (101) of the central portion (1) whereas the openings (148) of the fastening means (14*a*) consist of circular holes (as an alternative to the aforementioned vertical slots) suitable for cooperating with said pins with an enlarged head.

Finally, it must be noted that, although so far it has been assumed that the universal holder in question(S) is used to support bottles (F) containing personal hygiene products, there is nothing to prevent it from being used in any other situation to support bottles of products in fluid state of a different nature and purpose.

Similarly, it should be emphasized that the holder in question(S) can be used both in a private and in a public space, such as in bathrooms and locker rooms of gyms, swimming pools, school buildings, factories, offices, etc.

The invention claimed is:

1. A holder for a bottle of a fluid product, the holder comprising:

a central portion adapted to be disposed along a vertical plane, said central portion having an inner surface adapted to face a wall and an outer surface opposite the inner surface;

a flexible strap projecting from said central portion;

a flexible strap projecting laterally from said central portion, said flexible strap having a fastener at a free end thereof;

a lock positioned at the outer surface of said central portion, said lock cooperative with the fastener of said flexible strap so as to lock the free end of said flexible strap against the outer surface of said central portion after disposing said flexible strap in an annular position around said central portion, wherein said flexible strap is formed of an elastic, soft and non-slip material so as to be elastically stretched and compressed so as to hold the bottle tightly in a suspended position, wherein the fastener of said flexible strap has openings, said lock having protruding elements that protrude from the outer surface of said central portion and are respectively engageable in the openings of the fastener of said flexible strap.

2. The holder of claim 1, wherein said flexible strap has a peripheral rib extending entirely around said flexible strap.

3. The holder of claim 1, wherein said flexible strap has a pair of longitudinal edges at the free end thereof, said flexible strap having a wavy profile formed of ridges and loops.

4. The holder of claim 1, wherein the ridges are positioned at a point at which the openings of the fastener of said flexible strap are located.

5. The holder of claim 1, wherein the openings of the fastener of said flexible strap are vertical slots, the protruding elements of said lock are hooks engageable into the vertical slots.

6. The holder of claim 1, wherein the openings of the fastener of said flexible strap are circular holes, the protruding elements of said lock being pins each with an enlarged head.

7. The holder of claim 1, wherein said starting powder has a substantially square profile comprising:

a rear vertical edge;

a rounded lower edge and a rounded upper edge; and a V-shaped front end joined to said flexible strap.

8. The holder of claim 1, wherein the hook lies in a common vertical plane with said central portion.

9. The holder of claim 1, wherein the holder is co-molded of two elements of respective different materials, the two elements comprising:

a load-bearing inner core that has a hooked portion having a profile identical to a profile of the hooks and a plate having a profile matching a profile of said central portion; and a soft elastic outer covering that covers said load-bearing inner core and which defines said flexible strap.

10. The holder of claim 9, wherein said lock is formed of one piece with said load-bearing inner core and projects from a window formed on said soft elastic outer covering.

11. A holder for a bottle of a fluid product, the holder comprising:

a central portion adapted to be disposed along a vertical plane, said central portion having an inner surface adapted to face a wall and an outer surface opposite the inner surface;

a flexible strap projecting from said central portion;

a flexible strap projecting laterally from said central portion, said flexible strap having a fastener at a free end thereof;

a lock positioned at the outer surface of said central portion, said lock cooperative with the fastener of said flexible strap so as to lock the free end of said flexible strap against the outer surface of said central portion after disposing said flexible strap in an annular position around said central portion, wherein said flexible strap is formed of an elastic, soft and non-slip material so as to be elastically stretched and compressed so as to hold the bottle tightly in a suspended position, wherein said lock is arranged in a groove aligned with said flexible strap, the groove having a height accommodating the free end of said flexible strap.

12. A holder for a bottle of a fluid product, the holder comprising:

a central portion adapted to be disposed along a vertical plane, said central portion having an inner surface adapted to face a wall and an outer surface opposite the inner surface;

a flexible strap projecting from said central portion;

a flexible strap projecting laterally from said central portion, said flexible strap having a fastener at a free end thereof;

a lock positioned at the outer surface of said central portion, said lock cooperative with the fastener of said flexible strap so as to lock the free end of said flexible strap against the outer surface of said central portion after disposing said flexible strap in an annular position around said central portion, wherein said flexible strap is formed of an elastic, soft and non-slip material so as to be elastically stretched and compressed so as to hold the bottle tightly in a suspended position; and at least one suction cup positioned at the outer surface of said central portion.

* * * * *